US009604742B2

(12) United States Patent
Yasutomi et al.

(10) Patent No.: US 9,604,742 B2
(45) Date of Patent: Mar. 28, 2017

(54) METHOD FOR PACKING CABLE

(71) Applicants: Furukawa Electric Co., Ltd., Tokyo (JP); Nippon Telegraph and Telephone Corp., Tokyo (JP)

(72) Inventors: Tetsuya Yasutomi, Tokyo (JP); Masayoshi Tsukamoto, Tokyo (JP); Noboru Okada, Tokyo (JP); Shigeo Kimura, Ishikawa (JP); Shigeo Kihara, Ishikawa (JP); Keiichiro Sugimoto, Ibaraki-ken (JP); Shinichi Niwa, Ibaraki-ken (JP)

(73) Assignees: FURUKAWA ELECTRIC CO., LTD., Tokyo (JP); NIPPON TELEGRAPH AND TELEPHONE CORPORATION, Tokyo (JP)

( * ) Notice: Subject to any disclaimer, the term of this patent is extended or adjusted under 35 U.S.C. 154(b) by 513 days.

(21) Appl. No.: 14/263,465

(22) Filed: Apr. 28, 2014

(65) Prior Publication Data

US 2014/0230375 A1 Aug. 21, 2014

Related U.S. Application Data

(62) Division of application No. 13/055,615, filed as application No. PCT/JP2009/063921 on Aug. 6, 2009, now abandoned.

(30) Foreign Application Priority Data

Aug. 8, 2008 (JP) ..... 2008-205424

(51) Int. Cl.
*B65B 5/04* (2006.01)
*B65B 11/58* (2006.01)
(Continued)

(52) U.S. Cl.
CPC ..... *B65B 5/04* (2013.01); *B65B 11/58* (2013.01); *B65B 63/04* (2013.01); *B65D 75/006* (2013.01);
(Continued)

(58) Field of Classification Search
CPC ..... B65B 5/04; B65B 11/025; B65B 11/04; B65B 11/58; B65B 25/24; B65B 27/06;
(Continued)

(56) References Cited

U.S. PATENT DOCUMENTS 1,640,368 A 8/1927 Obetz et al.
1,684,540 A 9/1928 Hooper
(Continued)

FOREIGN PATENT DOCUMENTS

DE 1586512 B1 * 8/1970 ..... B65H 55/00
FR 2817839 A1 * 6/2002 ..... B65D 85/04
(Continued)

OTHER PUBLICATIONS

International Search Report issued in PCT/JP09/063921 on Sep. 15, 2009.
(Continued)

*Primary Examiner* — Stephen F Gerrity
(74) *Attorney, Agent, or Firm* — Oblon, McClelland, Maier & Neustadt, L.L.P.

(57) ABSTRACT

Provided is a method for packing a cable having a static friction coefficient of 0.15 or more and 0.50 or less, a dynamic friction coefficient of 0.10 or more and 0.40 or less and a bending rigidity of 60 gf or more and 350 gf or less. The method includes the steps of: (1) winding the cable into a figure-of-eight shape to form a cylindrical cable bundle, (2) winding a wrapping film as a restraining member, which restrains the cable bundle, around an outer circumferential portion of the cable bundle, (3) winding a wrapping film as
(Continued)

a closing member which closes openings on both ends of the cable bundle, and (4) housing the cable bundle being wound with the restraining member and the closing member in a housing container.

4 Claims, 5 Drawing Sheets

(51) Int. Cl.

| | |
|---|---|
| ***B65B 63/04*** | (2006.01) |
| ***B65H 57/12*** | (2006.01) |
| ***B65H 49/08*** | (2006.01) |
| ***B65H 55/04*** | (2006.01) |
| ***B65D 85/671*** | (2006.01) |
| ***B65D 75/00*** | (2006.01) |
| ***B65D 75/38*** | (2006.01) |

(52) U.S. Cl.
CPC ..... *B65D 75/38* (2013.01); *B65D 85/671* (2013.01); *B65H 49/08* (2013.01); *B65H 55/046* (2013.01); *B65H 57/12* (2013.01); *B65B 2220/16* (2013.01); *B65H 2701/32* (2013.01)

(58) Field of Classification Search
CPC ... B65B 63/04; B65B 2220/16; B65D 75/006; B65D 75/38; B65D 85/04; B65D 85/671; B65D 85/675; B65D 2571/0003; B65D 2571/00685; B65H 49/08; B65H 54/62; B65H 55/00; B65H 55/04; B65H 55/046; B65H 57/12; B65H 81/02; B65H 2701/32
USPC ..... 53/409, 430, 441, 449, 465, 116, 556, 53/176, 204, 210, 211; 206/400, 409; 242/159, 163, 170, 171
See application file for complete search history.

(56) References Cited

U.S. PATENT DOCUMENTS

| | | | | | |
|---|---|---|---|---|---|
| 2,634,922 | A | | 4/1953 | Taylor, Jr. | |
| 2,716,008 | A | | 8/1955 | Taylor, Jr. | |
| 2,767,938 | A | * | 10/1956 | Taylor, Jr. | B65H 55/046 242/163 |
| 2,921,676 | A | * | 1/1960 | Carignan | B65D 75/5822 206/409 |
| 3,114,456 | A | * | 12/1963 | Van Billiard | B65H 55/00 206/409 |
| 3,264,272 | A | | 8/1966 | Watkin | |
| 3,677,491 | A | | 7/1972 | Gerwig | |
| 3,700,185 | A | * | 10/1972 | Hubbard et al. | B65H 49/08 242/129 |
| 3,803,796 | A | * | 4/1974 | Newman et al. | B65H 55/00 242/163 |
| 3,915,301 | A | * | 10/1975 | Gray et al. | B65H 49/08 206/409 |
| 3,982,712 | A | | 9/1976 | Bassett | |
| 4,019,636 | A | | 4/1977 | Wise | |
| 4,067,441 | A | | 1/1978 | Newman et al. | |
| 4,160,533 | A | | 7/1979 | Kotzur et al. | |
| 4,274,607 | A | | 6/1981 | Priest | |
| 4,467,916 | A | | 8/1984 | Hedden et al. | |
| 4,493,464 | A | | 1/1985 | Green et al. | |
| 4,687,294 | A | | 8/1987 | Angeles | |
| 4,724,960 | A | | 2/1988 | Goodrum et al. | |
| 4,817,796 | A | | 4/1989 | Camillo et al. | |
| 5,129,514 | A | * | 7/1992 | Lilley, Jr. | B65D 85/04 102/202.12 |
| 5,238,114 | A | * | 8/1993 | Irozuru | B65D 75/006 206/410 |
| 5,494,160 | A | | 2/1996 | Gelmetti | |
| 5,561,731 | A | | 10/1996 | Cooke et al. | |
| 5,628,167 | A | | 5/1997 | Huson et al. | |
| 5,918,745 | A | | 7/1999 | Main | |
| 5,979,812 | A | | 11/1999 | Kotzur et al. | |
| 6,253,532 | B1 | | 7/2001 | Orpen | |
| 6,264,031 | B1 | | 7/2001 | Pienta et al. | |
| 6,446,804 | B1 | | 9/2002 | Lehtineva | |
| 6,594,427 | B1 | | 7/2003 | Dixon et al. | |
| 7,321,709 | B2 | | 1/2008 | Yokokawa et al. | |
| 2003/0010663 | A1 | | 1/2003 | Barton et al. | |
| 2003/0012529 | A1 | | 1/2003 | Kobayashi et al. | |
| 2003/0012536 | A1 | | 1/2003 | Simomichi et al. | |
| 2003/0097940 | A1 | * | 5/2003 | Mazzoni et al. | B65B 27/06 100/2 |
| 2004/0258375 | A1 | | 12/2004 | Honjo et al. | |
| 2004/0261364 | A1 | * | 12/2004 | Karlheinz | B65B 11/04 53/419 |
| 2007/0104429 | A1 | | 5/2007 | Yokokawa et al. | |
| 2010/0000895 | A1 | * | 1/2010 | Weissbrod | B65D 85/04 206/395 |
| 2010/0322572 | A1 | | 12/2010 | Sakabe et al. | |

FOREIGN PATENT DOCUMENTS

| | | | | | |
|---|---|---|---|---|---|
| GB | 311122 | A | * | 5/1929 | B65D 85/675 |
| GB | 1 398 938 | | | 6/1975 | |
| GB | 2085404 | A | * | 4/1982 | B65D 85/04 |
| JP | 63-11373 | | | 1/1988 | |
| JP | 2001-52536 | | | 2/2001 | |
| JP | 2001-63784 | | | 3/2001 | |
| JP | 2004-359300 | | | 12/2004 | |
| JP | 2005-107441 | | | 4/2005 | |
| JP | 2006-248613 | | | 9/2006 | |
| JP | 2007-269382 | | | 10/2007 | |
| JP | 2007-326719 | | | 12/2007 | |

OTHER PUBLICATIONS

Extended Search Report issued in European Application No. 09805020.6 on Sep. 12, 2011.
Office Action issued in Japanese Patent Application No. 2008-205424 on Mar. 3, 2013.

* cited by examiner

METHOD FOR PACKING CABLE

CROSS-REFERENCE TO RELATED APPLICATIONS

This application is a division of U.S. application Ser. No. 13/055,615 filed Jan. 24, 2011, the entire contents of which is incorporated herein by reference. U.S. application Ser. No. 13/055,615 is a national stage of PCT/JP09/063,921 filed Aug. 6, 2009, which is based upon and claims the benefit of priority from prior Japanese Application No. 2008-205424 filed Aug. 8, 2008.

BACKGROUND OF THE INVENTION

Field of the Invention

The present invention relates to a packing configuration of a cable such as an optical fiber cable.

Description of Related Art

Heretofore, a variety of optical fiber cables have been manufactured and used. For example, in each of the optical fiber cables, a so-called optical fiber core wire having a coating composed of ultraviolet curing resin, thermosetting resin or the like on an outer circumference of a glass optical fiber is prepared, and this optical fiber core wire, a pair of tension members, and further, a support wire are collectively coated while being positioned at a predetermined position, whereby a sheath is formed.

Incidentally, as a packing configuration of these optical fiber cables, there is one in which the cable is housed in a housing container in a state of being wound in a figure-of-eight shape (for example, refer to Japanese Patent Application Laid-Open Publication No. 2001-63784). In this technique, while winding the cable around a barrel-like mandrel so as to draw the figure-of-eight shape, a rotation speed of the mandrel and a pitch for winding the cable around the same are controlled, whereby a bundle is formed while forming a hole in one radial spot of the bundle.

A winding terminal end of the cable is fixed to a box-like housing container such as a corrugated cardboard box that houses this bundle. In the box-like housing container, a hole is provided at a position corresponding to the above-described hole. A cylindrical guide member is inserted into the holes of the box-like housing container and the bundle, and a winding start end of the cable is inserted through the guide member. The cable is pulled out through the guide member to the outside of the box-like housing container, whereby the cable is paid out from an inner portion of the bundle in a state of sequentially collapsing.

It is known that, when this technique is used, a twist does not occur at the time of paying out the cable since the cable is wound in the figure-of-eight shape, and moreover, even if the cable is stopped being paid out, a situation does not occur where the mandrel freely rotates like a reel by inertia to break the winding of the cable, and the cable can be paid out favorably. Therefore, this technique is generally used for a cable having some rigidity, such as a LAN cable, an optical drop cable and an optical indoor cable.

Incidentally, in recent years, an indoor cable has been developed and examined, in which a diameter and friction of an outer sheath are decreased, as a result of making much of ease in insertion and feeding thereof through a conduit, and handling thereof. When the indoor cable, in which the friction of the outer sheath is decreased or bending rigidity is decreased by reducing the diameter, is wound into a bundle shape by the above mentioned technique, then the cable on the outside of the bundle becomes prone to be broken. Therefore, in order to house the bundle in the box-like housing container so that the bundle cannot be broken, an operation by two persons is required, and such an operation is troublesome.

Moreover, since the cable only has low rigidity, when the cable is paid out from the box-like housing container, and a length of the cable remaining therein is reduced, a circular shape of the whole bundle cannot be held, and the whole bundle collapses into an ellipsoidal shape. Furthermore, since adjacent portions of the bundled cable are prone to slip on each other, there has been a problem that not only a portion thereof which is about to be paid out at the present time but also a portion thereof up to a few rounds ahead are broken in the inside of the bundle, a phenomenon occurs that the cable is paid out while entangling such a broken portion, and a bend and a knot are generated in the cable.

SUMMARY OF THE INVENTION

It is an object of the present invention to provide a packing configuration of a cable, which makes it difficult to break the cylindrical shape of the cable bundle, and makes it difficult to generate the bend and the knot in the cable.

In order to solve the foregoing problems, provided is a packing configuration of a cable, reflecting one aspect of the present invention, including: a cylindrical cable bundle in which a cable is wound in a figure-of-eight shape; a restraining member which is arranged at an outer circumferential portion of the cable bundle, to restrain the cable bundle; and a housing container to house the cable bundle and the restraining member.

Further, provided is the packing configuration of the cable, wherein the restraining member is a wrapping film.

Further, provided is the packing configuration of the cable, wherein the restraining member restrains the cable by an elongation rate within a range of 10% to 200%.

Further, provided is the packing configuration of the cable, wherein a guide member which radially penetrates the cable bundle is provided in the cable bundle, and the restraining member is provided while avoiding the guide member.

Further, provided is the packing configuration of the cable, wherein a closing member which closes an opening on both ends of the cable bundle is provided.

Further, provided is the packing configuration of the cable, wherein the closing member is a wrapping film.

According to another aspect of the present invention, provided is a method for packing a cable having a static friction coefficient of 0.15 or more and 0.50 or less, a dynamic friction coefficient of 0.10 or more and 0.40 or less, and a bending rigidity of 60 gf or more and 350 gf or less. The method includes the steps of: (1) winding the cable into a figure-of-eight shape to form a cylindrical cable bundle, (2) winding a wrapping film as a restraining member, which restrains the cable bundle, around an outer circumferential portion of the cable bundle, (3) winding a wrapping film as a closing member which closes openings on both ends of the cable bundle, and (4) housing the cable bundle being wound with the restraining member and the closing member in a housing container.

In accordance with the present invention, there can be provided the packing configuration of a cable, which makes it difficult to break the cylindrical shape of the cable bundle, and makes it difficult to generate the bend and the knot in the cable.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as at definition of the limits of the present invention, and wherein.

DETAILED DESCRIPTION OF THE PREFERRED EMBODIMENTS

A description is given below in detail of the present invention.

First Embodiment

Figure 1:
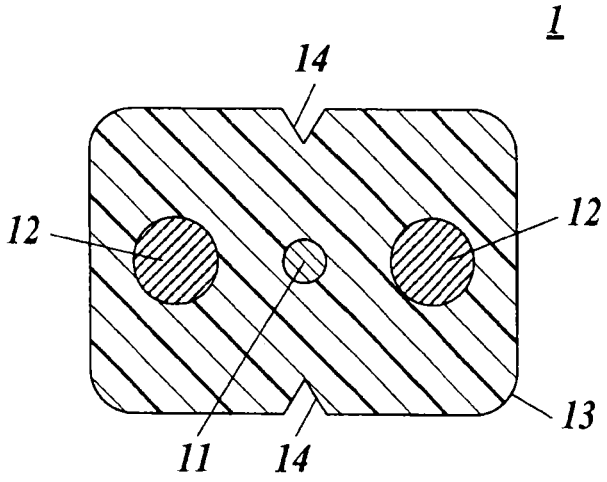
FIG. 1 is a cross-sectional view of an indoor cable 1 according to an embodiment of the present invention, taken perpendicularly to a length direction thereof.

FIG. 1 is a cross-sectional view of an indoor cable 1 according to an embodiment of the present invention, taken perpendicularly to a length direction thereof. As shown in FIG. 1, the indoor cable 1 is schematically composed of: an optical fiber core wire 11; two tension members 12; and a sheath 13 that collectively coats these.

On longitudinal both sides on a cross section of the indoor cable 1, the tension members 12 are individually arranged apart from the optical fiber core wire 11. The tension members 12 absorb tension acting on a body portion 2. As the tension members 12, for example, steel wires such as zinc plated steel wires, fiber reinforced plastics (FRP) and the like can be used.

The sheath 13 coats the optical fiber core wire 11 and the tension members 12, and as the sheath 13, for example, thermoplastic resin such as non-halogen flame retardant polyolefin can be used. Notches 14 are formed on center portions of the sheath 13, and the sheath 13 is ruptured from the notches 14, whereby it is possible to easily take out the optical fiber core wire 11.

The present invention can be optimally applied to an indoor cable 1 in which a range of bending rigidity is 60 gf or more (in conformity with IEC60794-1-2 E17, measured under condition of D=40 mm). This is because, when the bending rigidity is smaller than 60 gf, it becomes difficult to insert the indoor cable 1 into an already installed conduit in the case of using a construction method of inserting the cable through a conduit by pushing the cable thereinto. Meanwhile, when the bending rigidity is larger than 350 gf, management of the cable is deteriorated by a rebound thereof, and accordingly, it is preferable that the bending rigidity be 350 gf or less.

Moreover, the present invention can be optimally applied to an indoor cable in which a static friction coefficient of adjacent portions is 0.50 or less and a dynamic friction coefficient thereof is 0.40 or less. This is because, when the static friction coefficient is larger than 0.50, and the dynamic friction coefficient is larger than 0.40, it becomes difficult to insert the indoor cable 1 into the already installed conduit in the case of using the construction method of inserting the cable through a conduit by pushing the cable thereinto. Moreover, when the static friction coefficient is smaller than 0.15, and the dynamic friction coefficient is smaller than 0.10, it becomes not only difficult to handle the cable since a winding breakage is likely to occur, but also a problem of a productivity deterioration occurs.

Figure 2:
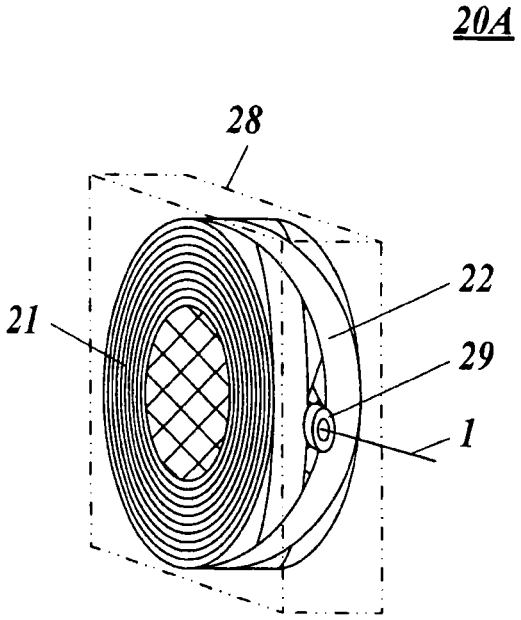
FIG. 2 is a perspective view showing a packing configuration 20A of the cable according to the present invention.

FIG. 2 is a perspective view showing a packing configuration 20A of the cable according to the first embodiment of the present invention. As shown in FIG. 2, the packing configuration 20A of the cable is composed of: a cable bundle 21; a restraining member 22; a box-like housing container 28; a guide member 29; and the like.

Figure 3:
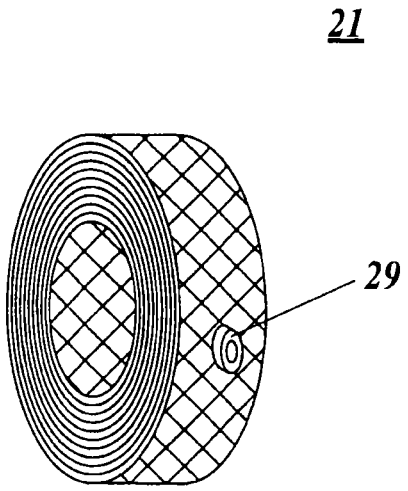
FIG. 3 is a perspective view of a cable bundle 21.

FIG. 3 is a perspective view of the cable bundle 21. The cable bundle 21 is formed by winding the indoor cable 1 into a figure-of-eight shape around a barrel-like mandrel (not shown), and thereafter, detaching the indoor cable 1 from the mandrel. A hole is formed in the cable bundle 21 by controlling a rotation speed of the mandrel and a pitch for winding the cable around the same. After the cable is detached from the mandrel, the guide member 29 is attached to this hole.

Figure 4:
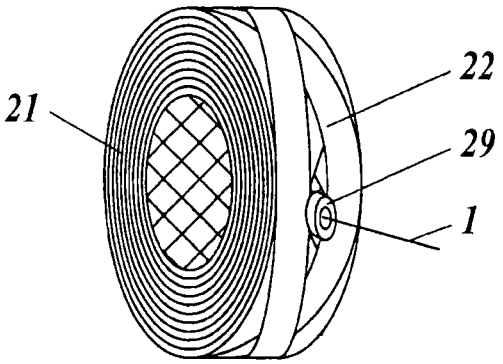
FIG. 4 is a perspective view showing a state where a restraining member 22 is wound around the cable bundle 21.

FIG. 4 is a perspective view showing a state where the restraining member 22 is wound around the cable bundle 21. The cable bundle 21, which is shown in FIG. 4 and has the restraining member 22 wound around the same, is obtained by winding the restraining member 22 around an outer circumferential portion of the cable bundle 21 in a state of being wound around the mandrel, and thereafter, detaching the indoor cable 1 from the mandrel. As the restraining member 22, for example, a wrapping film made of polyethylene or the like can be used. The restraining member 22 is wound while avoiding the hole to which the guide member 29 is attached.

In the case of using the wrapping film as the restraining member 22, it is preferable that an elongation rate of the wrapping film be within the range of 10% to 200%. This is because restraining force of the restraining member 22 is weak when the elongation rate is smaller than 10%. Meanwhile, this is because it is difficult to wind the restraining member 22 when the elongation rate is larger than 200%.

In the case where friction or diameter of an outer sheath of the indoor cable 1 is decreased, the cable bundle 21 is particularly prone to be broken. However, the restraining member 22 is wound around the outer circumferential portion of the cable bundle 21, whereby a cylindrical shape of the cable bundle 21 becomes less likely to be broken, and the cable bundle 21 can be easily detached from the mandrel.

The box-like housing container 28 has a rectangular parallelepiped shape. In the box-like housing container 28, the cable bundle 21 around which the restraining member 22 is wound is housed. As the box-like housing container 28, for example, a box made of a corrugated cardboard can be used.

The restraining member 22 is wound around the outer circumferential portion of the cable bundle 21, whereby the cylindrical shape of the cable bundle 21 is less likely to be broken. Accordingly, the cable bundle 21 can be easily housed in the box-like housing container 28 even by one person.

A hole though which the guide member 29 is to be inserted is provided in the box-like housing container 28. An inner end portion of the indoor cable 1 is inserted through the guide member 29, and is pulled out to the outside of the box-like housing container 28. The indoor cable 1 is pulled out from the guide member 29, whereby the indoor cable 1 is paid out in a state of sequentially collapsing from an inner portion of the cable bundle 21.

Second Embodiment

Figure 5:
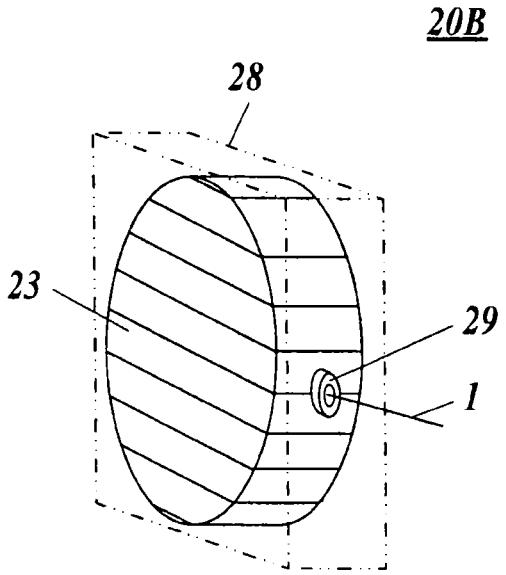
FIG. 5 is a perspective view showing a packing configuration 20B of the cable according to a second embodiment of the present invention.

FIG. 5 is a perspective view showing a packing configuration 20B of the cable according to a second embodiment of the present invention. Note that the cable bundle 21, the restraining member 22, the box-like housing container 28 and the guide member 29 are similar to those of the first embodiment, and accordingly, a description thereof is omitted. As shown in FIG. 5, for the cable bundle 21 detached from the mandrel, a closing member 23 may be further wound around the whole cable bundle 21 so as to close openings on both ends thereof. Moreover, although the openings on both ends are completely closed in FIG. 5, the closing member 23 may be wound so that the openings may be partially left open.

As the closing member 23, for example, a wrapping film made of polyethylene or the like can be used. The closing member 23 is wound while avoiding the guide member 29.

The openings on both ends of the cable bundle 21 are closed by the closing member 23, whereby the indoor cable 1 broken from the inner portion can be prevented from jumping out from the openings on both ends of the cable bundle 21.

Third Embodiment

Figure 6:
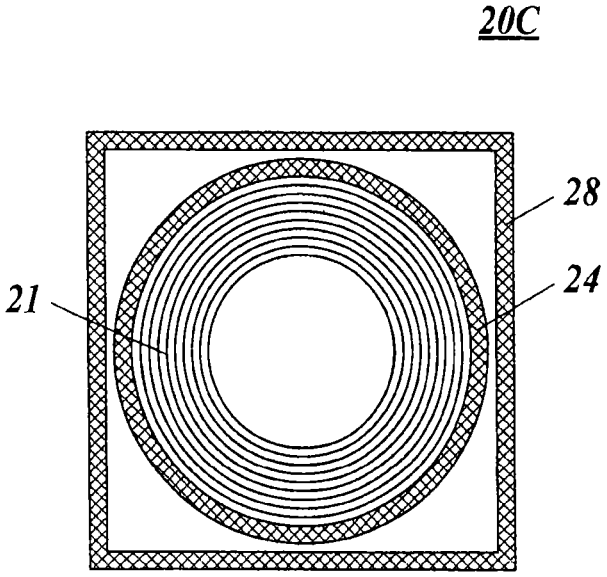
FIG. 6 is a schematic cross-sectional view showing a packing configuration 20C of the cable according to a third embodiment of the present invention.

FIG. 6 is a schematic cross-sectional view showing a packing configuration 20C of the cable according to a third embodiment of the present invention. Note that the cable bundle 21, the box-like housing container 28 and the guide member 29 are similar to those of the first embodiment, and accordingly, a description thereof is omitted. In this embodiment, a cylindrical member is used as a restraining member 24 to be wound around the outer circumferential portion of the cable bundle 21. As the restraining member 24, for example, a member made of a corrugated cardboard can be used.

Also in this embodiment, the restraining member 24 is wound around the outer circumferential portion of the cable bundle 21, whereby the cylindrical shape of the cable bundle 21 becomes less likely to be broken, and the cable bundle 21 can be easily detached from the mandrel. Moreover, the cable bundle 21 can be easily housed in the box-like housing container 28 even by one person.

Fourth Embodiment

Figure 7:
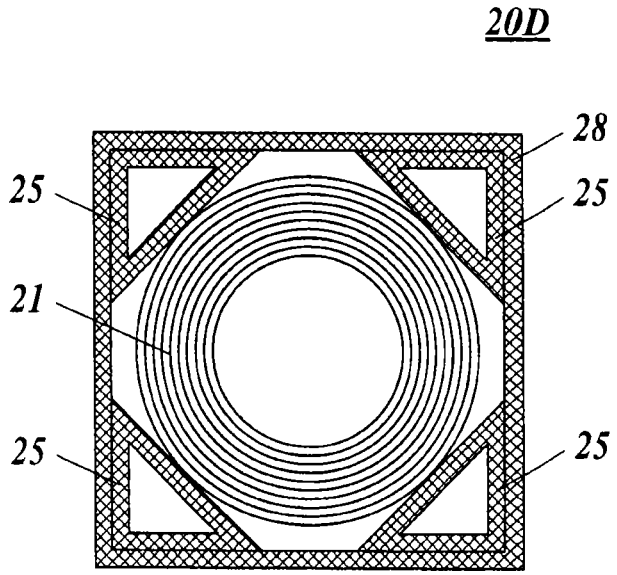
FIG. 7 is a schematic cross-sectional view showing a packing configuration 20D of the cable according to a fourth embodiment of the present invention.

FIG. 7 is a schematic cross-sectional view showing a packing configuration 20D of the cable according to a fourth embodiment of the present invention. The cable bundle 21, the box-like housing container 28 and the guide member 29 are similar to those of the first embodiment, and accordingly, a description thereof is omitted. In this embodiment, the cylindrical cable bundle 21 is housed in the inside of the rectangular parallelepiped box-like housing container 28, and restraining members 25 which close gaps between the box-like housing container 28 and the cable bundle 21 are arranged on four corners of the box-like housing container 28. The restraining members 25 have a triangular prism shape, and are formed, for example, of corrugated cardboards.

Also in this embodiment, the outer circumferential portion of the cable bundle 21 is restrained by the restraining members 25 and the box-like housing container 28, whereby the cylindrical shape of the cable bundle 21 becomes less likely to be broken, and the cable bundle 21 can be easily detached from the mandrel.

Fifth Embodiment

Figure 8:
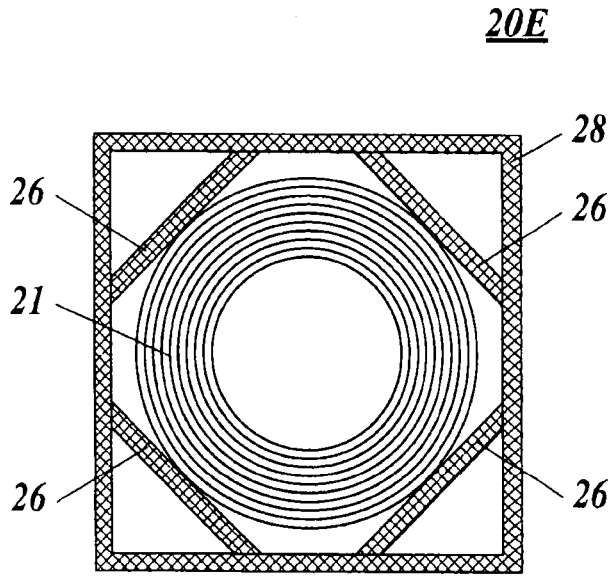
FIG. 8 is a schematic cross-sectional view showing a packing configuration 20E of the cable according to a fifth embodiment of the present invention.

FIG. 8 is a schematic cross-sectional view showing a packing configuration 20E of the cable according to a fifth embodiment of the present invention. The cable bundle 21, the box-like housing container 28 and the guide member 29 are similar to those of the first embodiment, and accordingly, a description thereof is omitted. As shown in FIG. 8, plate-like restraining members 26 may be fixed to the four corners of the box-like housing container 28, and the cable bundle 21 may be restrained thereby. As the restraining members 26, for example, corrugated cardboards can be used.

A description is given below more in detail of the present invention by citing examples.

Example 1

A wrapping film was wound around an outer circumferential portion of a cable bundle formed by winding an indoor cable with a length of 1000 m into a figure-of-eight shape, and the cable bundle was housed in a box-like housing container made of a corrugated cardboard. Then, a pay-out test to be described below was performed by using a packing configuration thus obtained.

[Configuration of Indoor Cable]

A diameter of an optical fiber core wire was set at 0.25 mm.

As tension members, two zinc plated steel wires with a diameter of 0.4 mm were used.

As a sheath, non-halogen flame retardant polyolefin was used.

A dynamic friction coefficient of adjacent portions of the cable was 0.25, and a static friction coefficient thereof was 0.20.

Moreover, as the cable, one was used, in which bending rigidity (in conformity with IEC60794-1-2 E17C, measured under condition of D=40 mm) is 92 gf.

Figure 9:
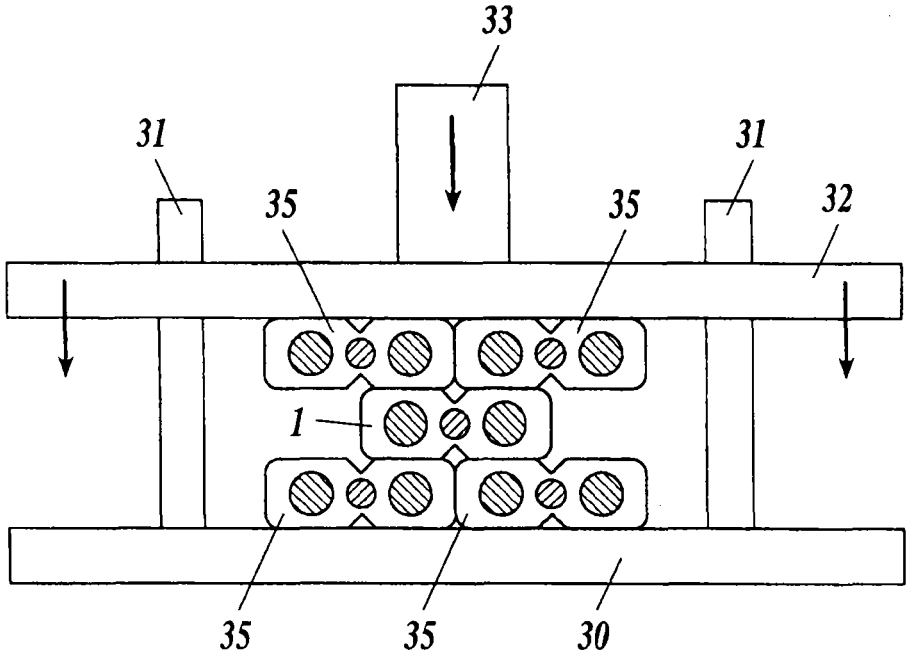
FIG. 9 is a schematic view showing a method for measuring a static friction coefficient and a dynamic friction coefficient.

Here, the dynamic friction coefficient and static friction coefficient of the adjacent portions of the cable were measured in the following manner. FIG. 9 is a schematic view showing a method for measuring the friction coefficients of the adjacent portions of the cable.

Specifically, on a base 30, two indoor cables 35 with a length of 150 mm, which are shown in FIG. 1, were arrayed adjacent and parallel to each other, and the indoor cable 1 with a length of 300 mm, which is a sample to be subjected to the measurement of the friction coefficients, was stacked thereon like a straw bag. On this optical fiber cable 1 as the sample (measurement sample), optical fiber cables 35 and 35 with a length of 150 mm, which are as mentioned above, were further stacked like straw bags as shown in FIG. 9.

Thereafter, a pressing plate 32 that slides up and down while being guided by a plurality of slide guides 31 vertically erected on the base 30 was mounted on the stacked cables so as to be parallel to the base 30. The same cables were used as the indoor cables 35 and 1.

Next, a weight 33 was mounted on the pressing plate 32, and a constant load of 19.6 N was applied to the pressing plate 32 in an arrow direction. In this state, the indoor cable 1 as the sample was pulled out frontward at a speed of 100 mm/min by using a load cell. As static friction force $F_S$, peak friction force when the indoor cable 1 started to move was employed, and a static friction coefficient $\mu_0=F_S/19.6$ N was obtained. Meanwhile, as dynamic friction force $F_D$, an average value was employed, obtained from the values at positions ranging from 30 mm to 80 mm from a point where the friction force exhibited the lowest value after passing through the peak friction force when the indoor cable 1 started to move. By using this dynamic friction force $F_D$, a friction coefficient $\mu=F_D/19.6$ N was obtained. The number n of samples was set as n=3.

Note that a testing environment was set such that a temperature was 23±2° C., and that humidity was 50±10%.

Incidentally, the indoor cables 15 and 20 were replaced every time when the test was completed once (n=1).

[Restraining Member]

As a restraining member, a polyethylene-made wrapping film with a width of 100 mm and a thickness of 0.03 mm was used.

Wrapping film winding strength (tension applied to the wrapping film when the wrapping film is wound) was set at 100 to 200 g, and the number of winding times was set at one. At this time, the elongation rate of the wrapping film was approximately 10%.

For the above-described packing configuration of the cable, the indoor cable was paid out from a guide member ten times by 1000 m (1000 m×ten times), and the number of bend occurrences was measured.

Example 2

The wrapping film winding strength was set at 100 to 200 g, and the number of winding times was set at two. Except for these, testing conditions were set similar to those of Example 1.

Example 3

The wrapping film winding strength was set at 100 to 200 g, and the number of winding times was set at three. Except for these, testing conditions were set similar to those of Example 1.

Example 4

The wrapping film winding strength was set at 1400 to 1600 g, and the number of winding times was set at one. Except for these, testing conditions were set similar to those of Example 1. At this time, the elongation rate of the wrapping film was approximately 100%.

Example 5

The wrapping film winding strength was set at 1400 to 1600 g, and the number of winding times was set at two. Except for these, testing conditions were set similar to those of Example 1.

Example 6

The wrapping film winding strength was set at 1400 to 1600 g, and the number of winding times was set at three. Except for these, testing conditions were set similar to those of Example 1.

Example 7

The wrapping film winding strength was set at 2800 to 3200 g, and the number of winding times was set at one. Except for these, testing conditions were set similar to those of Example 1. At this time, the elongation rate of the wrapping film was approximately 200%.

Example 8

The wrapping film winding strength was set at 2800 to 3200 g, and the number of winding times was set at two. Except for these, testing conditions were set similar to those of Example 1.

Example 9

The wrapping film winding strength was set at 2800 to 3200 g, and the number of winding times was set at three. Except for these, testing conditions were set similar to those of Example 1.

Comparative Example 1

The restraining member was not used. Except for this, testing conditions were set similar to those of Example 1.

Example 10

As the cable, one was used, in which bending rigidity (in conformity with IEC60794-1-2 E17C, measured under condition of D=40 mm) is 253 gf.

The wrapping film winding strength was set at 100 to 200 g, and the number of winding times was set at one. Except for these, testing conditions were set similar to those of Example 1. At this time, the elongation rate of the wrapping film was approximately 10%.

Example 11

The wrapping film winding strength was set at 100 to 200 g, and the number of winding times was set at two. Except for these, testing conditions were set similar to those of Example 10.

Example 12

The wrapping film winding strength was set at 100 to 200 g, and the number of winding times was set at three. Except for these, testing conditions were set similar to those of Example 10.

Example 13

The wrapping film winding strength was set at 1400 to 1600 g, and the number of winding times was set at one. Except for these, testing conditions were set similar to those of Example 10. At this time, the elongation rate of the wrapping film was approximately 100%.

Example 14

The wrapping film winding strength was set at 1400 to 1600 g, and the number of winding times was set at two. Except for these, testing conditions were set similar to those of Example 10.

Example 15

The wrapping film winding strength was set at 1400 to 1600 g, and the number of winding times was set at three. Except for these, testing conditions were set similar to those of Example 10.

Example 16

The wrapping film winding strength was set at 2800 to 3200 g, and the number of winding times was set at one. Except for these, testing conditions were set similar to those of Example 10. At this time, the elongation rate of the wrapping film was approximately 200%.

Example 17

The wrapping film winding strength was set at 2800 to 3200 g, and the number of winding times was set at two. Except for these, testing conditions were set similar to those of Example 10.

Example 18

The wrapping film winding strength was set at 2800 to 3200 g, and the number of winding times was set at three. Except for these, testing conditions were set similar to those of Example 10.

Comparative Example 2

The restraining member was not used. Except for this, testing conditions were set similar to those of Example 10.

Example 19

The closing member was wound around the cable bundle so as to close 60% of an opening area of the openings on both ends thereof. As the closing member, a polyethylene-made wrapping film with a width of 100 mm and a thickness of 0.03 mm was used, and the wrapping film winding strength was set at 100 to 200 g. Except for these, testing conditions were set similar to those of Example 1. At this time, an elongation rate of the wrapping film used as the closing member was approximately 10%.

Example 20

As the restraining member, the cylindrical restraining member made of the corrugated cardboard, which is shown in FIG. 6, was used. Except for this, testing conditions were set similar to those of Example 1.

Example 21

As the restraining member, the triangular prism restraining member made of the corrugated cardboard, which is shown in FIG. 7, was used. Except for this, testing conditions were set similar to those of Example 1.

Example 22

As the cable, one was used, in which bending rigidity (in conformity with IEC60794-1-2 E17C, measured under condition of D=40 mm) is 253 gf. Except for this, testing conditions were set similar to those of Example 19.

Example 23

As the restraining member, the triangular prism restraining member made of the corrugated cardboard, which is shown in FIG. 7, was used. Except for this, testing conditions were set similar to those of Example 21.

RESULTS

Results are shown in Table 1, Table 2 and Table 3.

TABLE 1

| | EXAMPLE 1 | EXAMPLE 2 | EXAMPLE 3 | EXAMPLE 4 | EXAMPLE 5 |
|---|---|---|---|---|---|
| BENDING RIGIDITY | 92 gf | 92 gf | 92 gf | 92 gf | 92 gf |
| WRAPPING FILM WINDING STRENGTH | 100-200 g | 100-200 g | 100-200 g | 1400-1600 g | 1400-1600 g |
| NUMBER OF WRAPPING FILM WINDING TIMES | 1 | 2 | 3 | 1 | 2 |
| NUMBER OF BEND OCCURRENCES WHEN CABLE IS PAID OUT (1000 M × TEN TIMES) | 3 | 0 | 0 | 1 | 0 |

| | EXAMPLE 6 | EXAMPLE 7 | EXAMPLE 8 | EXAMPLE 9 | COMPARATIVE EXAMPLE 1 |
|---|---|---|---|---|---|
| BENDING RIGIDITY | 92 gf | 92 gf | 92 gf | 92 gf | 92 gf |
| WRAPPING FILM WINDING STRENGTH | 1400-1600 g | 2800-3200 g | 2800-3200 g | 2800-3200 g | — |
| NUMBER OF WRAPPING FILM WINDING TIMES | 3 | 1 | 2 | 3 | — |
| NUMBER OF BEND OCCURRENCES WHEN CABLE IS PAID OUT | 0 | 1 | 0 | 0 | 25 |

TABLE 1-continued (1000 M × TEN TIMES)

| | EXAMPLE 10 | EXAMPLE 11 | EXAMPLE 12 | EXAMPLE 13 | EXAMPLE 14 |
|---|---|---|---|---|---|
| BENDING RIGIDITY | 253 gf | 253 gf | 253 gf | 253 gf | 253 gf |
| WRAPPING FILM WINDING STRENGTH | 100-200 g | 100-200 g | 100-200 g | 1400-1600 g | 1400-1600 g |
| NUMBER OF WRAPPING FILM WINDING TIMES | 1 | 2 | 3 | 1 | 2 |
| NUMBER OF BEND OCCURRENCES WHEN CABLE IS PAID OUT (1000 M × TEN TIMES) | 1 | 0 | 0 | 0 | 0 |

| | EXAMPLE 15 | EXAMPLE 16 | EXAMPLE 17 | EXAMPLE 18 | COMPARATIVE EXAMPLE 2 |
|---|---|---|---|---|---|
| BENDING RIGIDITY | 253 gf | 253 gf | 253 gf | 253 gf | 253 gf |
| WRAPPING FILM WINDING STRENGTH | 1400-1600 g | 2800-3200 g | 2800-3200 g | 2800-3200 g | — |
| NUMBER OF WRAPPING FILM WINDING TIMES | 3 | 1 | 2 | 3 | — |
| NUMBER OF BEND OCCURRENCES WHEN CABLE IS PAID OUT (1000 M × TEN TIMES) | 0 | 0 | 0 | 0 | 11 |

TABLE 2

| | EXAMPLE 19 |
|---|---|
| BENDING RIGIDITY | 92 gf |
| WRAPPING FILM WINDING STRENGTH | 100-200 g |
| NUMBER OF WRAPPING FILM WINDING TIMES | 1 |
| CLOSING MEMBER | PRESENT |
| NUMBER OF BEND OCCURRENCES WHEN CABLE IS PAID OUT (1000M × TEN TIMES) | 0 |

TABLE 3

| | EXAMPLE 20 | EXAMPLE 21 | EXAMPLE 22 | EXAMPLE 23 |
|---|---|---|---|---|
| BENDING RIGIDITY | 92 gf | 92 gf | 253 gf | 253 gf |
| CABLE RESTRAINING MEMBER | TRIANGULAR PRISM MEMBER | CYLINDRICAL MEMBER | TRIANGULAR PRISM MEMBER | CYLINDRICAL MEMBER |
| MATERIAL OF RESTRAINING MEMBER | CORRUGATED CARDBOARD | CORRUGATED CARDBOARD | CORRUGATED CARDBOARD | CORRUGATED CARDBOARD |
| NUMBER OF BEND OCCURRENCES WHEN CABLE IS PAID OUT (1000M × TEN TIMES) | 0 | 0 | 0 | 0 |

Three bends occurred in Example 1. One bend occurred in each of Examples 4, 7 and 10. No bends occurred in Examples 2, 3, 5, 6, 8, 9 and 11 to 18.

Meanwhile, 25 bends occurred in Comparative example 1, and 11 bends occurred in Comparative example 2.

Moreover, the bends were less likely to occur in the examples where the restraining member was wound two or three times than in the examples where the restraining member was wound only once. This is because the restraining force for the cable bundle is strengthened by winding the restraining member a plurality of times.

Moreover, no bends occurred in Example 19 where the closing member was provided in addition to the restraining member.

Furthermore, no bends occurred in Examples 20 to 23, either, each of which uses, as the restraining member, the cylindrical restraining member made of the corrugated cardboard, which is shown in FIG. 6, or the triangular prism restraining member made of the corrugated cardboard, which is shown in FIG. 7.

As described above, the cable bundle is restrained by the restraining member, whereby an occurrence frequency of the bends can be reduced.

Although various exemplary embodiments have been shown and described, the invention is not limited to the embodiments shown. Therefore, the scope of the invention is intended to be limited solely by the scope of the clams that follow.

The invention claimed is:

1. A method for packing a cable having a static friction coefficient of 0.15 or more and 0.50 or less, a dynamic friction coefficient of 0.10 or more and 0.40 or less, and a bending rigidity of 60 gf or more and 350 gf or less, the method comprising:

(1) winding the cable into a figure-of-eight shape to form a cylindrical cable bundle, (2) winding a wrapping film as a restraining member, which restrains the cable bundle, around an outer circumferential portion of the cable bundle, (3) winding a wrapping film as a closing member which closes openings on both ends of the cable bundle, and (4) housing the cable bundle, which wound with the restraining member and the closing member, in a housing container.

2. The method for packing a cable of claim 1, further comprising:

attaching a guide member, before the step (2), such that the guide member radially penetrates the cable bundle, wherein the step (2) is winding the wrapping film as the restraining member while avoiding the guide member, and the step (3) is winding the wrapping film as the closing member while avoiding the guide member.

3. The method for packing a cable of claim 2, wherein the step (2) is winding the wrapping film as the restraining member such that the restraining member restrains the cable by an elongation rate within a range of 10% to 200%.

4. The method for packing a cable of claim 1, wherein the step (2) is winding the wrapping film as the restraining member such that the restraining member restrains the cable by an elongation rate within a range of 10% to 200%.

* * * * *